US010586668B2

(12) United States Patent
Girlando et al.

(10) Patent No.: US 10,586,668 B2
(45) Date of Patent: Mar. 10, 2020

(54) HVDC DISCONNECTOR

(71) Applicant: GENERAL ELECTRIC TECHNOLOGY GMBH, Baden (CH)

(72) Inventors: Vincenzo Girlando, Padua (IT); Marco Nosilati, Noventa di Piave (IT); Enrico Zozzolotto, Noventa di Piave (IT)

(73) Assignee: GENERAL ELECTRIC TENCHNOLOGY GMBH, Baden (CH)

( * ) Notice: Subject to any disclaimer, the term of this patent is extended or adjusted under 35 U.S.C. 154(b) by 0 days.

(21) Appl. No.: 16/095,101

(22) PCT Filed: Apr. 20, 2016

(86) PCT No.: PCT/EP2016/058793

§ 371 (c)(1),
(2) Date: Oct. 19, 2018

(87) PCT Pub. No.: WO2017/182073

PCT Pub. Date: Oct. 26, 2017

(65) Prior Publication Data

US 2019/0122841 A1 Apr. 25, 2019

(51) Int. Cl.

| | |
|---|---|
| ***H01H 1/38*** | (2006.01) |
| ***H01H 31/28*** | (2006.01) |
| ***H01H 33/02*** | (2006.01) |
| ***H01H 33/04*** | (2006.01) |
| ***H01H 33/08*** | (2006.01) |
| ***H01H 33/12*** | (2006.01) |
| ***H01H 33/59*** | (2006.01) |
| ***H01H 33/60*** | (2006.01) |

(52) U.S. Cl.

CPC ..... *H01H 33/60* (2013.01); *H01H 1/38* (2013.01); *H01H 31/283* (2013.01); *H01H 33/025* (2013.01); *H01H 33/045* (2013.01); *H01H 33/08* (2013.01); *H01H 33/12* (2013.01); *H01H 33/596* (2013.01)

(58) Field of Classification Search

CPC .... H01H 33/60; H01H 33/025; H01H 33/045; H01H 33/08; H01H 33/12; H01H 31/283; H01H 1/38

USPC ..... 218/11, 12, 16, 45, 48, 67, 80, 100; 200/50.39, 146 R, 48 CB

See application file for complete search history.

(56) References Cited

U.S. PATENT DOCUMENTS 3,629,531 A * 12/1971 Trolin ..... H01H 31/30 174/43
3,634,634 A * 1/1972 Cole ..... H01H 31/30 200/48 SB
5,276,286 A * 1/1994 Demissy ..... H01H 31/003 218/10

(Continued)

*Primary Examiner* — Edwin A. Leon
*Assistant Examiner* — William A Bolton
(74) *Attorney, Agent, or Firm* — Eversheds Sutherland (US) LLP

(57) ABSTRACT

A HVDC disconnector is disclosed. The HVDC disconnector comprises a fixed contact comprising a guide and a pair of conducting members positioned in the guide wherein the first and second conducting members are both tulip contacts; a movable contact comprising a fixed arm and a mobile arm having a conducting terminal, wherein the mobile arm is movable from an open position to a closed position to close a connection between the fixed contact and the second contact.

13 Claims, 12 Drawing Sheets

(56) References Cited

U.S. PATENT DOCUMENTS

| | | | | | |
|---|---|---|---|---|---|
| 5,293,012 | A * | 3/1994 | Levi | H01H 31/28 | 200/275 |
| 5,369,234 | A * | 11/1994 | Demissy | H01H 31/003 | 200/48 R |
| 6,538,206 | B1 * | 3/2003 | Roberts | H01H 31/023 | 174/138 G |
| 7,223,928 | B2 * | 5/2007 | Riopka | H01H 31/00 | 200/48 P |
| 7,804,033 | B2 * | 9/2010 | Dianin | H01H 31/28 | 200/48 CB |

* cited by examiner

HVDC DISCONNECTOR

TECHNICAL FIELD

This disclosure relates in general to the field of High Voltage Direct Current (HVDC) transmission systems, to HVDC disconnectors and more particularly, to knee-type HVDC disconnectors.

BACKGROUND

HVDC development started with the transmission of power in an order of magnitude of a few hundred MW and has continuously increased to large transmission ratings over long distances. By these developments, HVDC has become a mature and reliable technology with increasing power capacity that require systems capable of handling the increased power capacity.

A HVDC electric power distribution system uses direct current for the transmission of electrical power. HVDC transmission systems may be less expensive and may suffer lower electrical power losses over long-distance transmission. Generally, a HVDC transmission system comprises an overhead or cable transmission line and a terminal station. HVDC disconnectors may be used to connect and disconnect a transmission line from a terminal station.

In order to improve operating performance and to handle increased power capacity, there is a rising trend towards composite insulators instead of traditional glass and porcelain insulators. With composite insulators there is a greater need for the contacts to have larger contact areas and to have a greater ability to handle the increased power capacity. In addition separated contacts have an important role in view of the effect of pollution on the electrostatic field in HVDC systems.

Generally, knee-type disconnectors have one rotating and two fixed insulators. The knee-type HVDC disconnectors have a mobile arm that moves along a vertical plane. Thus, knee-type disconnectors enable distance between adjacent poles to be reduced in order to have a reduced overall space occupation. Knee-type disconnectors are preferred for use in HVDC transmission lines in view of the overall dimension.

The present disclosure is directed, at least in part, to improving or overcoming one or more aspects of the prior art system.

BRIEF SUMMARY OF THE INVENTION

In a first aspect, the present disclosure describes a HVDC disconnector that comprises a fixed contact comprising a guide and a first and second conducting members positioned in the guide wherein the first and second conducting members are both tulip contacts; a movable contact comprising a fixed arm and a mobile arm having a conducting terminal, wherein the mobile arm is movable from an open position to a closed position to close a connection between the fixed contact and the second contact.

In a second aspect, the present disclosure describes a method of closing a connection in a HVDC disconnector. The method comprises the steps of actuating a movable contact having a fixed arm and a mobile arm having a conducting terminal so as to move the mobile arm from an open position to a closed position in a fixed contact comprising a guide and a pair of conducting members disposed in the guide wherein the first and second conducting members are both tulip contacts.

BRIEF DESCRIPTION OF THE DRAWINGS

The foregoing and other features and advantages of the present disclosure will be more fully understood from the following description of various embodiments, when read together with the accompanying drawings, in which.

DETAILED DESCRIPTION

This disclosure generally relates to a HVDC disconnector. In an embodiment, the HVDC disconnector is a knee-type disconnector.

Figure 1:
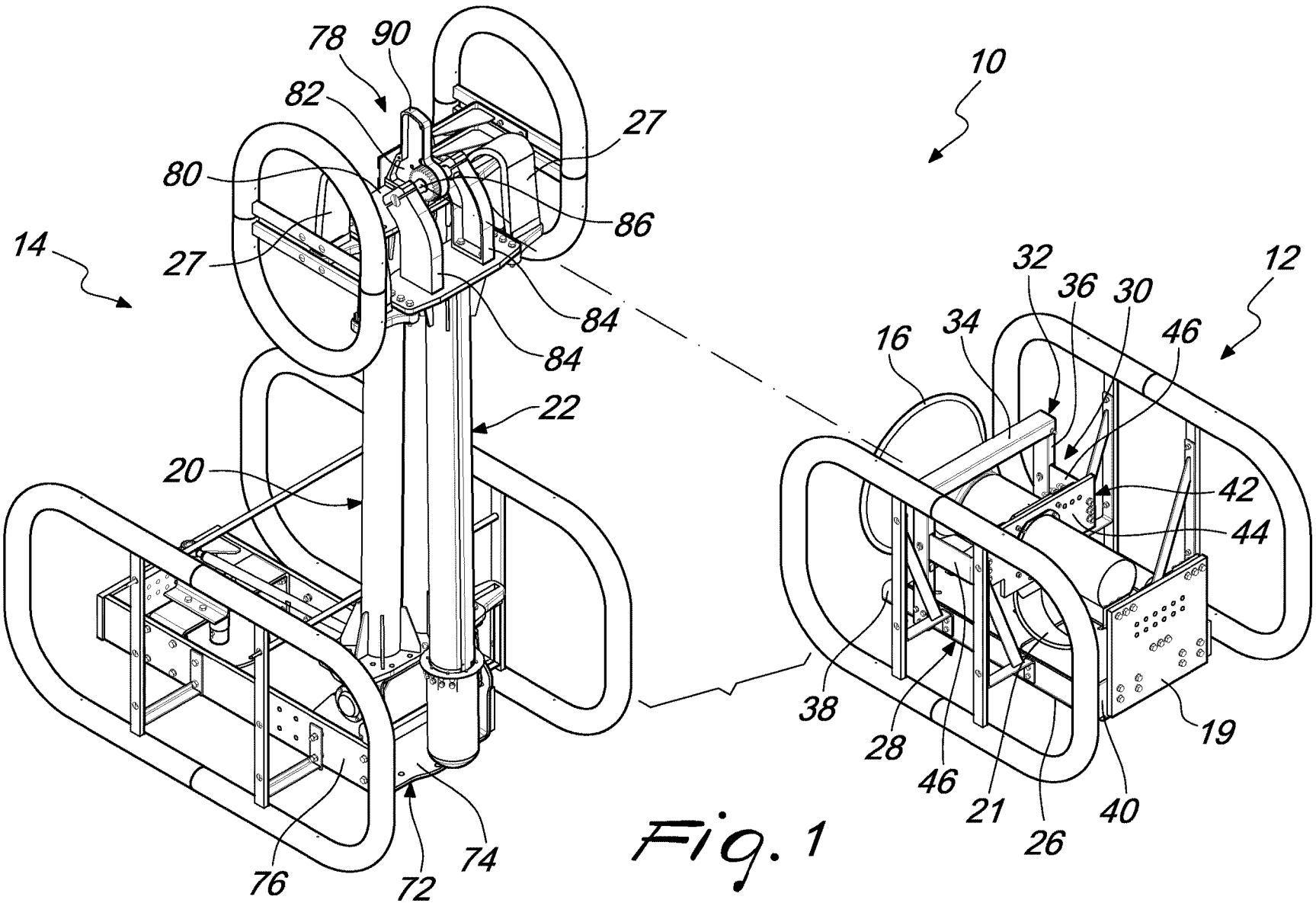
FIG. 1 is an isometric view of a knee-type HVDC disconnector according to the present disclosure.

FIG. 1 illustrates an exemplary knee-type HVDC disconnector 10. The HVDC disconnector 10 comprises a fixed contact 12 and a movable contact 14. The closing and opening of an electrical connection between the fixed contact 12 and a movable contact 14 is determined by the physical engagement between fixed contact 12 and the movable contact 14.

Figure 2:
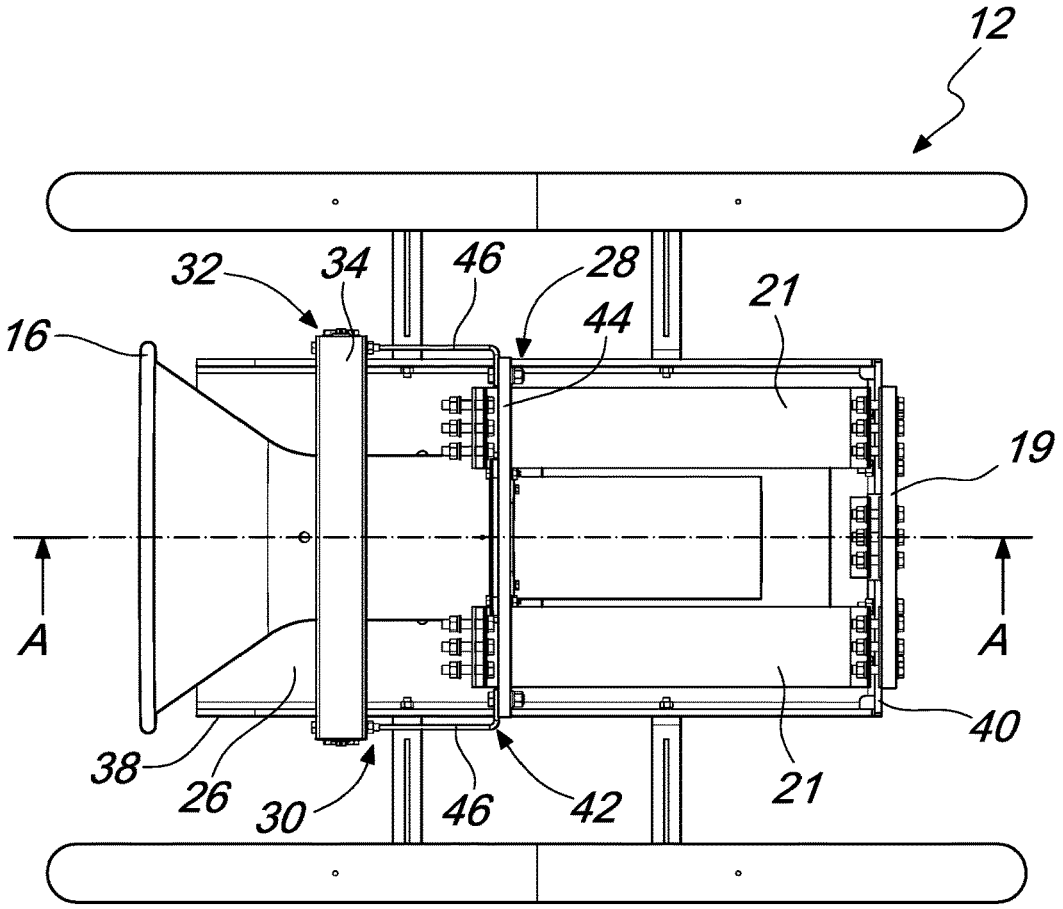
FIG. 2 is a plan view of a fixed contact of the knee-type HVDC of FIG. 1.
Figure 3:
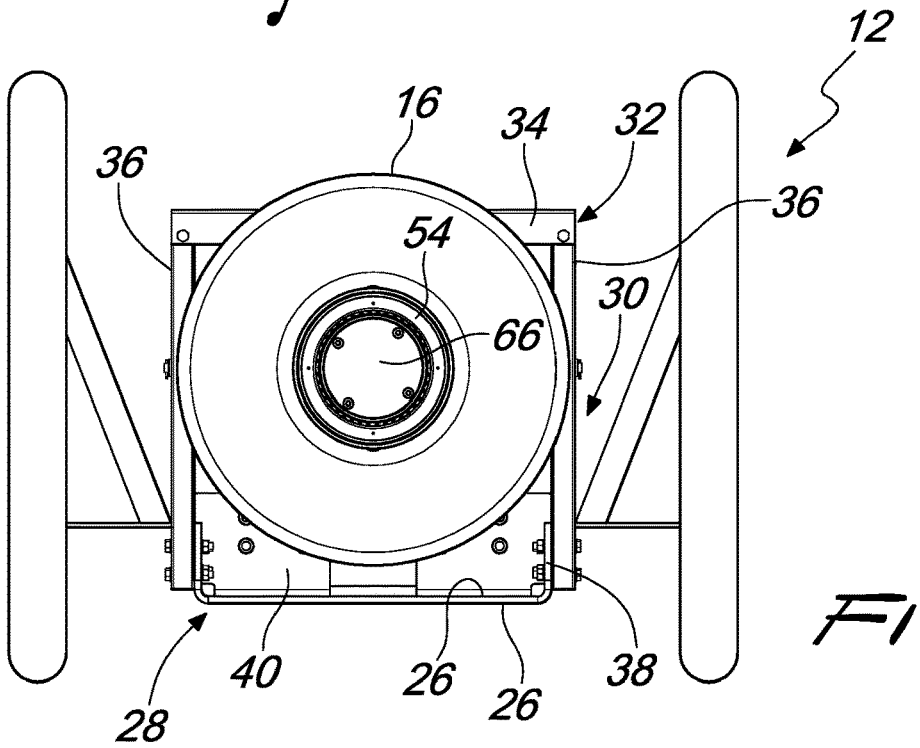
FIG. 3 is a front view of the fixed contact of the FIG. 2.

With respect to FIGS. 1, 2 and 3, fixed contact 12 comprises a guide 16 and a flange 28. Flange 28 is configured to serve as support structure for the guide 16. Flange 28 has a form of a flat plate with planar surfaces 26. Planar surfaces 26 are formed on opposite sides of the flange 28. Flange 28 has a resting plane which defined with respect to the planar surfaces 26. Flange 28 has folded sides 38 that extend away from the planar surfaces 26. Flange 28 may be formed from aluminium.

Flange 28 is fixedly joined to the guide 16 by mechanical methods. In an embodiment, the flange 28 is bolted to the guide 16. In a further embodiment, the flange 28 is glued to the guide 16.

Fixed contact 12 further comprises a support 30. Support 30 is connected to the flange 28. The support 30 comprises a stand 32 having a crossbar 34 and two upright bars 36. Crossbar 34 is substantially perpendicular to the two upright bars 36. Upright bars 36 are substantially mutually parallel. Upright bars 36 are connected to the respective ends of the crossbar 34. Opposite ends of the upright bars 36 are connected to the flange 28.

Upright bars 36 extend in a direction substantially perpendicular from the planar surfaces 26 of the flange 28.

Folded sides 38 of the flange 28 provide a surface for attachment of the upright bars 36. Ends of the upright bars 36 are bolted to the folded sides 38. In an embodiment, ends of the upright bars 36 are welded to the folded sides 38. In an embodiment, flange 28 has a folded end 40.

An end panel 19 is connected to the folded end 40. A pair of flexible aluminium connections 21 are provided between the guide 16 and the end panel 19. Flexible aluminium connections 21 enable the transmission of electrical current between connections on the guide 16 and the respective connections on the end panel 19.

Support 30 further comprises a bracket 42. Bracket 42 comprises a panel 44 and two beams 46. Panel 44 has a form of a flat plate. Beams 46 are connected to opposite ends of the panel 44. Beams 46 extend in a direction substantially perpendicular to the panel 44. Beams 46 are mutually parallel. Beams 46 are in a form of flat plates.

Panel 44 is substantially perpendicular to the planar surface 26 of the flange 28. Beams 46 extend in a direction substantially parallel to the planar surface 26 of the flange 28.

Bracket 42 is joined to the stand 32. Beams 46 connect panel 44 to the upright bars 36 of the stand 32. Panel 44 is substantially parallel to the stand 32. Beams 46 are substantially perpendicular to the stand 32. Bracket 42 is connected to the stand 32 so as to be suspended over the flange 28. Bracket 42 is spaced from the planar surfaces 26 of the flange 28.

Guide 16 is coupled to the support 30 through the bracket 42. Guide 16 is supported over the flange 28 by the bracket 42. The guide 16 being isolated by the support 30 prevents arcing to occur between the movable contact 14 and fixed contact 12 during their mutual engagement.

FIGS. 4, 4A, 5 and 5A, illustrate a section through the fixed contact 12. The fixed contact 12 further comprises a first conducting member 18 and a second conducting member 18. The first and second conducting members 18 are positioned in the guide 16. The guide 16 comprises a first guide portion 48 and a second guide portion 50. In an embodiment, the guide 16 may further comprise a third guide portion 51. The second guide portion 50 is positioned between the first guide portion 48 and the third guide portion 51.

In an embodiment, first guide portion 48 and second guide portion 50 are formed as a monolithic body. In an alternative embodiment, first guide portion 48 and second guide portion 50 are formed as separate bodies that are joined together. The separate bodies are joined through either mechanical or adhesive means. In a further embodiment, third guide portion 51 is connected to the second guide portion 50 through either mechanical or adhesive means. In yet a further embodiment, third guide portion 51 and the second guide portion 50 are formed as a monolithic body.

First guide portion 48 has a shape to facilitate entry of the movable contact 14 into the guide 16 for contact with the first and second conducting members 18. The contact of the movable contact 14 with the first and second conducting members 18 enables electrical connection to be established between the fixed and movable contacts 12, 14.

First guide portion 48 has a hollow body with a first opening 52. First opening 52 serves as the opening for the guide 16. Opposite the first opening 52 is a transitional zone 54. A section through the transitional zone 54 may be a plane that is transverse to the longitudinal axis of the guide 16.

First opening 52 and transitional zone 54 are disposed at opposite ends of the first guide portion 48. Transitional zone 54 is located at the transition from the first guide portion 48 to the second guide portion 50. First opening 52 is larger relative to the transitional zone 54. In an embodiment, first opening 52 has a greater diameter relative to a diameter of a section through the transitional zone 54.

First guide portion 48 may guide the movable contact 14 from the first opening 52 to the transitional zone 54. First guide portion 48 may guide the movable contact 14 to the second guide portion 50.

First guide portion 48 has a conical shape. In an embodiment, first guide portion 48 may be formed as a truncated cone with the first opening 52 forming the base and the transitional zone 54 forming the top.

Second guide portion 50 has first connections 23 for connection to respective ends of the flexible aluminium connections 21. The other ends of the flexible aluminium connections 21 are connected to respective second connections 25 that are positioned on the end panel 19.

Second guide portion 50 has a hollow body. The second guide portion 50 may have a form of a hollow tube. Lumen of the second guide portion 50 has a constant diameter along the hollow tube. Second guide portion 50 has a longitudinal axis 58.

The movable contact 14 is movable in the second guide portion 50. Second guide portion 50 shares the transitional zone 54 which serves as an opening for the second guide portion 50. The end of the second guide portion 50 that is opposite the transitional zone 54 has a second opening 53. The first opening 52 and the second opening 53 have planes that are mutually parallel.

In an embodiment, the second guide portion 50 may be mounted to the panel 44 at the end with the second opening 53. The second guide portion 50 extends perpendicularly from the panel 44. The first guide portion 48 and the second guide portion 50 are supported on the panel 44 through the mounting of the end with the second opening 53 to the panel 44. The panel 44 partially occludes the second opening 53. The first guide portion 48 and the second guide portion 50 are supported on the panel 44 through a mounting bracket or a mounting flange extending from the second guide portion 50.

Third guide portion 51 has a tubular shape with an opening 55 and a closed end 56. The third guide portion 51 is formed as a hollow tube with a single closed end. Lumen of the third guide portion 51 has a constant diameter. The closed end 56 seals the third guide portion 51 and the guide 16.

Third guide portion 51 has a longitudinal axis that is aligned to the longitudinal axis 58 of the second guide portion 50. Longitudinal axis 58 is a common axis of the coaxially aligned second guide portion 50 and third guide portion 51.

The third guide portion 51 is mounted to panel 44 at the side opposite to the side with the second guide portion 50. The third guide portion 51 extends perpendicularly from the panel 44. The third guide portion 51 is supported on the panel 44 through a mounting bracket or a mounting flange extending from the third guide portion 51.

The lumen of the third guide portion 51 communicates with the lumen of the second guide portion 50 through the panel 44. Panel 44 has an aperture 59 that enables a continuous passage from the second guide portion 50 to the third guide portion 51.

The diameter of the second opening 53 of the second guide portion 50 is substantially greater relative to the diameter of the aperture 59 of the panel 44. The diameter of the lumen of the second guide portion 50 is substantially greater relative to the diameter of the aperture 59 of the panel 44.

The diameter of the opening 55 of the third guide portion 51 is substantially equal to the diameter of the aperture 59 of the panel 44. The diameter of the lumen of the third guide portion 51 is substantially equal to the diameter of the aperture 59 of the panel 44.

The diameter of the second opening 53 of the second guide portion 50 is substantially greater relative to the diameter of the opening 55 of the third guide portion 51. The diameter of the lumen of the second guide portion 50 is substantially greater relative to the diameter of the lumen of the third guide portion 51. The second opening 53, the aperture 59 and the opening 55 are concentrically aligned.

The guide 16 further comprises a collar 61. Collar 61 has a form of a hollow tube with openings at both ends 63, 65. Lumen of the collar 61 has a constant diameter. Collar 61 is positioned within the lumen of the second guide portion 50. The end 65 of collar 61 is mounted to the panel 44. The collar 61 extends perpendicularly from the panel 44.

Collar 61 extends within the lumen of the second guide portion 50 from the panel 44 towards transition zone 54. Collar 61 extends partially within the lumen of the second guide portion 50. End 63 is suspended within the lumen of the second guide portion 50 remote from the transition zone 54. Plane of the opening at end 63 is substantially parallel to the plane of the transition zone 54. Plane of the opening at end 63 is substantially parallel to the plane of the first opening 52.

Collar 61 has a longitudinal axis that is aligned to the longitudinal axis 58 of the second guide portion 50. Longitudinal axis 58 is a common axis of the coaxially aligned second guide portion 50, third guide portion 51 and collar 61.

Collar 61 is mounted so as to encircle the aperture 59 of the panel 44. Openings at both ends 63, 65 have substantially the same diameter of the aperture 59 of the panel 44. The lumen of the collar 61 communicates with the lumen of the third guide portion 51 through the panel 44. The aperture 59 enables a continuous passage from the collar 61 to the third guide portion 51.

The diameter of the opening at end 63 of the collar 61 is substantially equal relative to the diameter of the opening 55 of the third guide portion 51 and the aperture 59 of the panel 44. The diameter of the lumen of the collar 61 is substantially equal relative to the diameter of the lumen of the third guide portion 51. The second opening 53, the aperture 59, the hole 55 and the openings of the collar 61 are concentrically aligned. The internal walls of the aperture 59 and respective walls of the lumens of collar 61 and third guide portion 51 are aligned so as to form a duct 67.

Duct 67 extends from end 63 of the collar 61 to closed end 56 of the third guide portion 51. In an embodiment, duct 67 has a uniform diameter from end 63 to closed end 56.

Collar 61 has an external wall that is inclined towards the end 63. Thickness of the walls of collar 61 may decrease towards end 63. The external walls are inclined towards the internal walls. External walls are inclined towards the longitudinal axis 58. Cross-section of the collar 61 may be wedge shaped at the tip of end 63.

In an embodiment, the second guide portion 50 may extend through the panel 44 such that the second guide portion 50 is continuous with the third guide portion 51 through a change in the diameter of the second guide portion 50. In an alternative embodiment, the third guide portion 51 may extend through the panel 44 so as to be continuous with the collar 61.

In an embodiment, guide 16 may be made of anodised aluminium. The guide 16 enables heat generated during the transmission of electricity to be dissipated effectively.

Second guide portion 50 houses the first and second conducting members 18 within the lumen thereof. The lumen of the transitional zone 54 enables entry of the movable contact 14 to engage the first and second conducting members 18 in the second guide portion 50. The first and second conducting members 18 are spaced away from the transitional zone 54.

First and second conducting members 18 each have a contact end 69 and a fixed end 71. The first and second conducting members 18 are orientated such that the respective contact ends 69 are positioned towards the transitional zone 54 and the respective fixed ends 71 are positioned towards mounting plate 44.

Contact ends 69 are spaced from the transitional zone 54. Contact ends 69 are positioned between the transitional zone 54 and end 63 of the collar 61. Contact ends 69 freely extend between the transitional zone 54 and end 63 of the collar 61. The contact ends 69 of the first and second conducting members 18 have contact portions 73 for electrical contact with the movable contact 14. Each contact portion 73 has a contact surface 62.

Fixed ends 71 are spaced from the mounting plate 44. Fixed ends 71 are positioned between the ends 63, 65 of the collar 61. Collar 61 provides for cantilever anchorage of the first and second conducting members 18. First and second conducting members 18 are mounted to the collar 61 as a cantilever so as to enable contact ends 69 to be freely extend from the collar 61. First and second conducting members 18 are positioned on the external wall of the collar 61. First and second conducting members 18 follow the inclined external walls towards the end 63 and extend beyond end 63.

Fixed ends 71 are anchored to the collar 61. Fixed ends 71 are anchored to the collar 61 between the ends 63, 65. Fixed ends 71 may be anchored by chemical or mechanical means. In an embodiment, fixed ends 71 are bolted to the collar 61. Contact ends 69 are substantially inclined relative to the fixed ends 71. The diameter of the first and second conducting members 18 at the contact ends 61 is smaller relative to the diameter at the fixed ends 71.

In an embodiment, the first and second conducting members 18 are positioned in series relative to the longitudinal axis 58 of the second guide portion 50. First and second conducting members 18 are arranged coaxially relative to the longitudinal axis 58. First and second conducting members 18 are mutually concentric relative to the longitudinal axis 58.

The conducting members 18 enables heat generated during electricity transmission to be dissipated the effectively through the guide 16. In an embodiment, the conducting members 18 are silver coated.

The first and second conducting members 18 consist of a first tulip contact 18*a* and a second tulip contact 18*b*. The tulip contacts 18*a*, 18*b* are both annularly arranged on the external wall of the collar 61. The tulip contacts 18*a*, 18*b* are positioned in series relative to the longitudinal axis 58 of the second guide portion 50. Tulip contacts 18*a*, 18*b* are arranged coaxially relative to the longitudinal axis. Tulip contacts 18*a*, 18*b* are mutually concentric relative to the longitudinal axis 58.

The contact end 69 of the first tulip contact 18*a* is positioned nearer to the transitional zone 54 relative to the contact end 69 of the second tulip contact 18*b*. Contact portion 73 of the first tulip contact 18*a* is positioned nearer to the transitional zone 54 relative to the contact portion 73 of the second tulip contact 18*b*.

Tulip contacts 18*a*, 18*b* are contiguously positioned on the collar 61. Tulip contact 18*b* is positioned between the collar 61 and tulip contact 18*a*. Fixed end 71 of tulip contact 18*b* is sandwiched between collar 61 and fixed end of tulip contact 18*a*.

Tulip contacts 18*a*, 18*b* are disposed so as to be mutually overlapping on the collar 61. Tulip contact 18*a* partially overlaps the tulip contact 18*b* relative to the longitudinal axis 58 of the second guide portion 50. The tulip contacts 18*a*, 18*b* have different cross-sections in order to be overlappingly positioned. In an embodiment, the tulip contacts 18*a*, 18*b* have different diameters. Tulip contact 18*a* has a greater diameter relative to the diameter of tulip contact 18*b*. The tulip contacts 18*a*, 18*b* are concentrically positioned such that the first tulip contact 18*a* surrounds the second tulip contact 18*b*.

Figure 4:
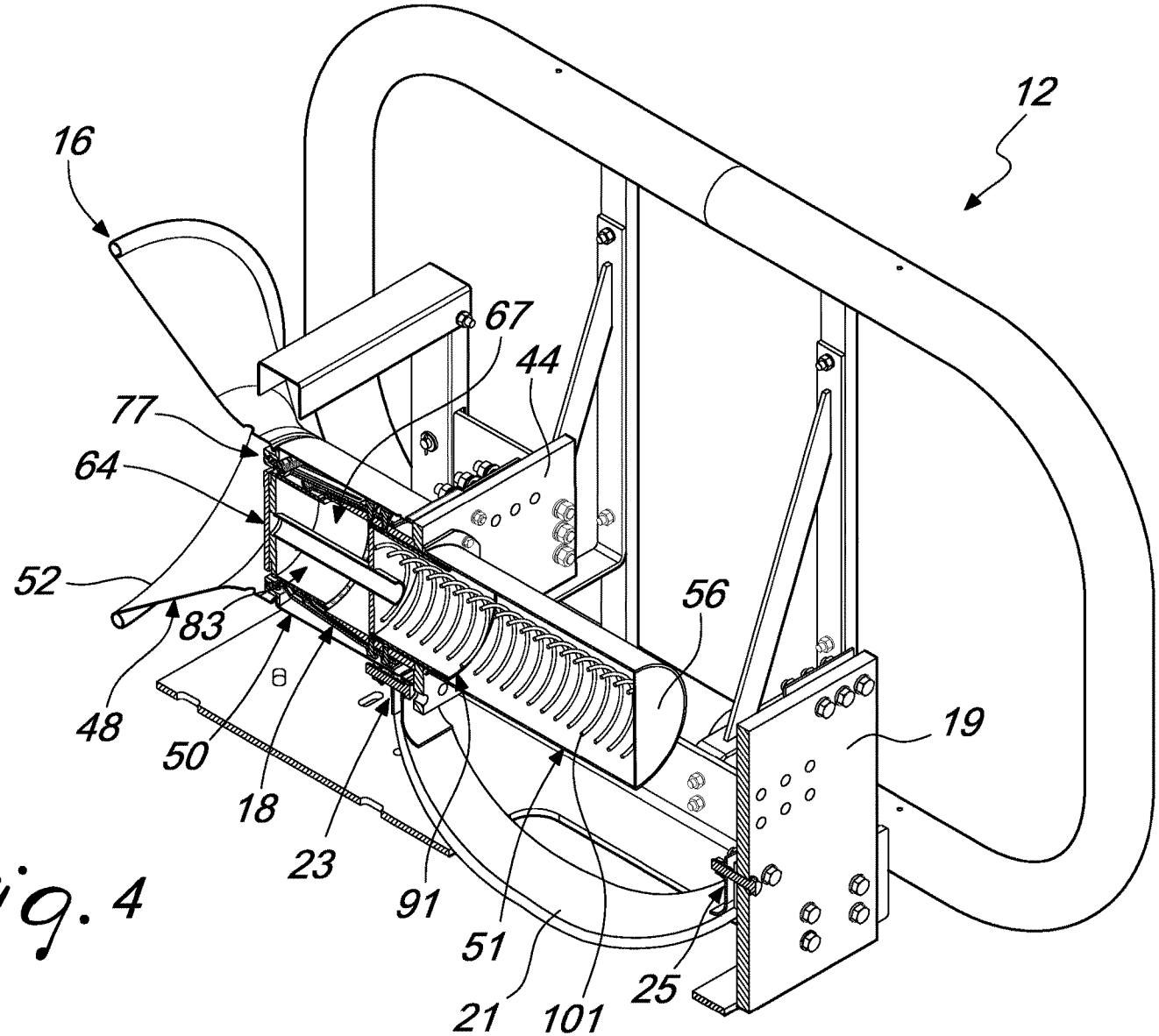
FIG. 4 is a sectional view of the fixed contact of the FIG. 1.
Figure 4A:
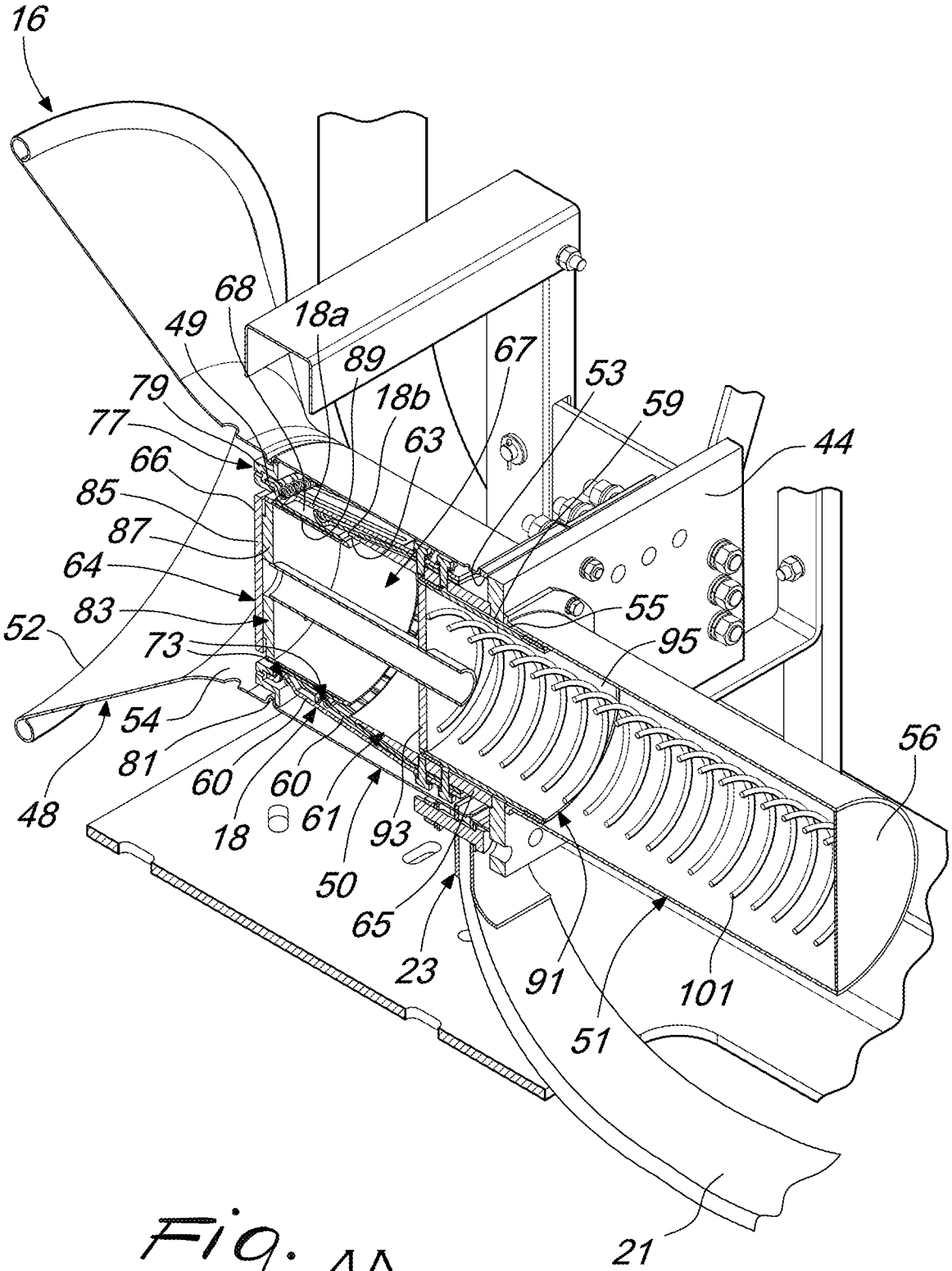
FIG. 4A is an enlargement of the sectional view of the FIG. 4.
Figure 5:
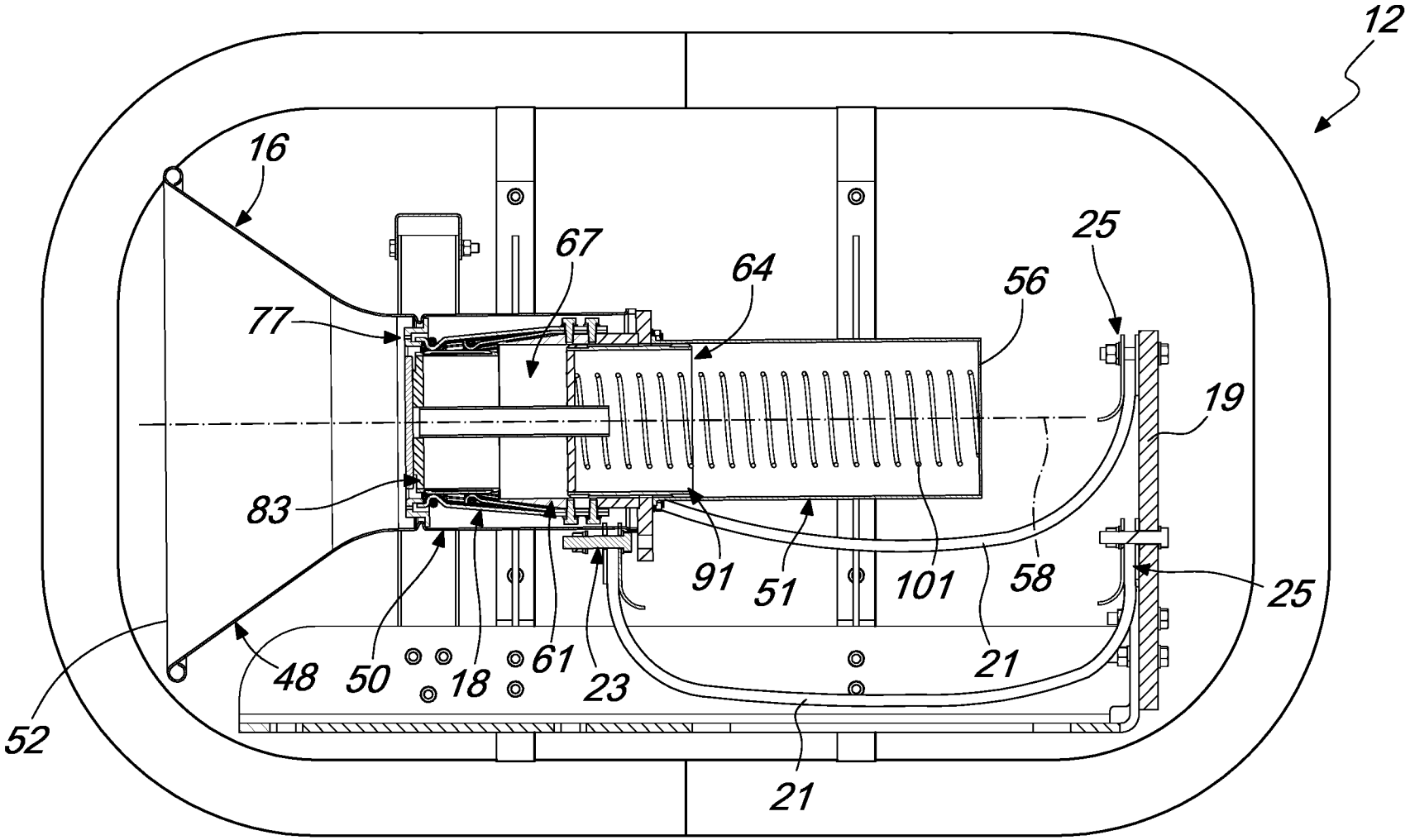
FIG. 5 is a cross-sectional view through the line A-A of the fixed contact of the FIG. 2.
Figure 5A:
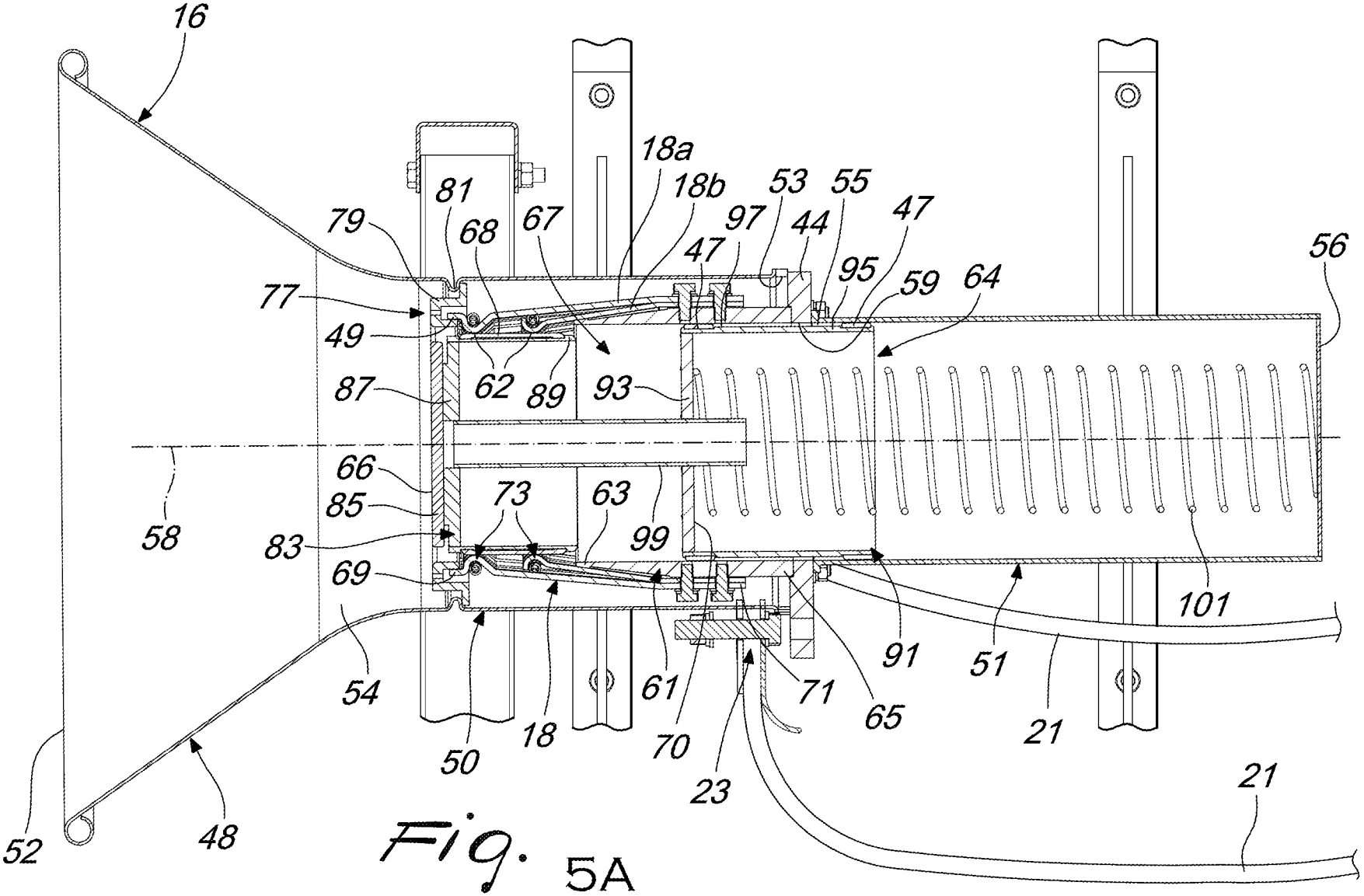
FIG. 5A is an enlargement of the cross-sectional view of the FIG. 5.

With respect to FIG. 4*a*, each tulip contact 18*a*, 18*b* has a plurality of fingers 60 for contact with the movable contact 14. Plurality of fingers 60 of each tulip contact 18*a*, 18*b* are radially arranged around the longitudinal axis 58 of the second guide portion 50. Plurality of fingers 60 of each tulip contact 18*a*, 18*b* are inclined away from the internal wall of the second guide portion 50. Plurality of fingers 60 follow the inclination of the external wall of the collar 61.

The ends of the plurality of fingers 60 form the contact end 69 of the collar 61. Each finger 60 has the respective contact portion 73. Each finger 60 carries the contact portion 73 for engaging the corresponding contact surface on the movable contact 14.

Contact portions 73 are radially arranged around the longitudinal axis 58. Each contact portion 73 is formed as a protrusion that extends into the lumen of the second guide portion 50. The protrusion extends into the lumen of the second guide portion 50 beyond the internal wall of the collar 61. The protrusion extends in a direction substantially towards the longitudinal axis 58. Contact portions 73 are positioned between the transitional zone 54 and the end 63 of the collar 61. Contact portions 73 are positioned between the transitional zone 54 and duct 67. Contact portions 73 are axially aligned to the duct 67 relative to the longitudinal axis 58.

The contact surface 62 of each contact portion 73 faces the interior of the second guide portion 50. Contact surfaces 62 are axially aligned to the duct 67 relative to the longitudinal axis 58. The contact surfaces 62 of first tulip contact 18*a* is spaced from the contact surfaces 62 of second tulip contact 18*b*. The contact surfaces 62 of first contact 18*a* are arranged coaxially relative to the contact surfaces 62 of second tulip contact 18*b*. The respective contact surfaces 62 of the tulip contacts 18 are positioned substantially equidistant from the internal wall of the second guide portion 50.

In an embodiment, rings 75 may be positioned at the contact portions 73. The rings 75 may be located opposite the contact surfaces 62. Rings 75 may prevent movement of the contact portions 73 in a direction away from the longitudinal axis 58.

Guide 16 may further comprise an abutting element 77. Abutting element 77 has an abutting portion 79. In an embodiment, abutting element 77 is an annular ring having a central hole through which the movable contact 14 is passable. The abutting portion 79 is a u shaped protrusion of the abutting element 77.

Abutting element 77 is disposed in the second guide portion 50. Abutting element 77 is positioned between the transitional zone 54 and the second opening 53 of the second guide portion 50. Abutting element 77 may be positioned adjacent the transitional zone 54. Abutting element 77 is mounted to the internal wall of the second guide portion 50. Abutting element 77 may be chemically or mechanically supported in the second guide portion 50. Abutting element 77 is disposed such that the abutting portion 79 protrudes towards the first opening 52 and away from the second opening 53.

Abutting portion 79 is spaced from the walls of the guide so as to be available for abutting engagement with the movable contact 14. The internal surface of the abutting portion 79 is aligned with the end 63 of the collar 61 relative to the longitudinal axis 58. Abutting portion 79 is aligned with the internal wall end 63 of the collar 61. Contact portions 73 of the first and second tulip contacts 18, 18*b* extend beyond abutting portion 79 and the end 63 of the collar 61 into the lumen of the second guide portion 50 toward the longitudinal axis 58.

In an embodiment, abutting element 77 is positioned adjacent the edge of the contact end 69 of the tulip contact 18*a*. Edge 49 of each finger 60 of the tulip contact 18*a* is in contact with the abutting element 77. Edge 49 of each finger 60 of the tulip contact 18*a* are inserted into side of the abutting portion 79 facing the second opening 53. Edge 49 of each finger 60 of the tulip contact 18*a* are inserted into cavity of the u-shaped abutting portion 79 that faces the second opening 53.

Second guide portion 50 has a neck 81. Neck 81 is an internal constriction of wall of the second guide portion 50 adjacent the transitional zone 54. Abutting element 77 is supported in the lumen of the second guide portion 50 by neck 81. In an embodiment, abutting element 77 is supported in the lumen of the second guide portion 50 by neck 81 and the edge 49 of each finger 60 of the tulip contact 18*a*.

The fixed contact 12 further comprises an arcing contact element 64. The arcing contact element 64 is movably supported in the guide 16. The arcing contact element 64 is movably supported in the second guide portion 50. Arcing contact element 64 is axially movable. Arcing contact element 64 extends from the second guide portion 50 into the third guide portion 51 through the duct 67. Arcing contact element 64 is axially movable along the longitudinal axis 58 of the second guide portion 50. Arcing contact element 64 is axially movable in the duct 67.

Arcing contact element 64 has a dimension to fit within the contact surfaces 62 of the conducting members 18. Arcing contact element 64 has a dimension to engagingly fit within the contact surfaces 62. Arcing contact element 64 has a dimension to be linearly movable within the duct 67. Arcing contact element 64 has a shape that corresponds to the shape of the duct 67.

Arcing contact element 64 has an abutting plate 85. Abutting plate 85 is available for abutting contact with the mobile arm 14. Abutting plate 85 has an abutting surface 66 for abutting contact with the mobile arm 14. Abutting plate 85 is orientated to be substantially perpendicular to the longitudinal axis 58. The abutting plate 85 is substantially flat. Abutting surface 66 faces the first opening 52.

Arcing contact element 64 has a first sliding support 83 for movably supporting the abutting plate 66. First sliding support 83 is slidingly supported for axial movement through the second guide portion 50. First sliding support 83 is slidingly supported for axial movement through the duct 67. The transverse dimension of the first sliding support 83 is smaller than the transverse dimension of the duct 67. The diameter of the first sliding support 83 is smaller than the diameter of the lumen of duct 67. The diameter of the first sliding support 83 is smaller than the diameter of the abutting element 77. The first sliding support 83 is movable through the central hole of the abutting element 77.

First sliding support 83 has a first coupling plate 87 and a first skirt 89 having a first sliding surface 68. The first skirt 89 encircles the edge of the second coupling plate 87. The second coupling plate 87 has a surface that is coupled to the abutting plate 85. The abutting plate 85 is chemically or mechanically mounted to the coupling plate 87. First sliding surface 68 is substantially perpendicular to the abutting surface 66. In an embodiment, abutting surface 66 is spaced from the adjacent edge of the first sliding surface 68. In an embodiment, abutting surface 66 is spaced from the edge of the first sliding surface 68 that encircles the abutting plate 85.

First sliding surface 68 engages the contact surfaces 62 of the contact members 18 as the arcing contact element 64 moves axially through the second guide portion 50 and the third guide portion 51. Contact surfaces 62 slide on the first sliding surface 68 as the arcing contact element 64 moves axially through the second guide portion 50. First sliding surface 68 does not engage walls of the duct 67 as the arcing contact element 64 moves axially through the duct 67.

Arcing contact element 64 has a second sliding support 91 for movably supporting the first sliding support 83. Second sliding support 91 is slidingly supported for axial movement through the duct 67. Second sliding support 91 slidingly engages the wall of duct 67. The transverse dimension of the second sliding support 91 is smaller than the transverse dimension of the duct 67 so as to slide along the wall of the duct 67. The diameter of the second sliding support 91 is suitably provided so as to slide along the wall of the duct 67.

Second sliding support 91 has a second coupling plate 93 and a second skirt 95 having a second sliding surface 97. Second sliding surface 97 may be configured for sliding. Second sliding surface 97 may be provided with discrete sliding portions 47. The second skirt 95 encircles the edge of the second coupling plate 93. The second sliding support 91 is connected to the first sliding support 83 by a staff 99. Staff 99 is tube shaped and is hollow. Staff 99 is axially aligned to the longitudinal axis 58. Staff 99 is substantially perpendicular to the abutting surface 66. The diameter of the second sliding support 91 is greater than the diameter of the first sliding support 83.

The staff 99 is coupled at an end to the first coupling plate 87 and at the other end to the second coupling plate 93. Staff 99 is inserted into a hole in the first coupling plate 87 and extends through the second coupling plate 93. First coupling plate 87 and second coupling plate 93 are mutually parallel.

A biasing surface 70 is provided on a side of the second coupling plate 93 which serves as a surface for engaging a biasing element 101. Biasing surface 70 is provided on the side that is opposite the side that faces the first coupling plate 87. Second skirt 95 surrounds the biasing surface 70. The biasing surface 70 faces the closed end 56 of the third guide portion 51.

Second sliding surface 97 engages the wall of duct 67 as the arcing contact element 64 moves axially through the second guide portion 50 and the third guide portion 51. Second sliding surface 97 slides against the wall of duct 67 as the arcing contact element 64 moves axially through the second guide portion 50 and the third guide portion 51. Engagement of the second sliding surface 97 with the wall of duct 67 enables the first sliding surface 68 to maintain sliding contact with the contact surfaces 62 as the arcing contact element 64 moves axially through the duct 67.

Figure 10:
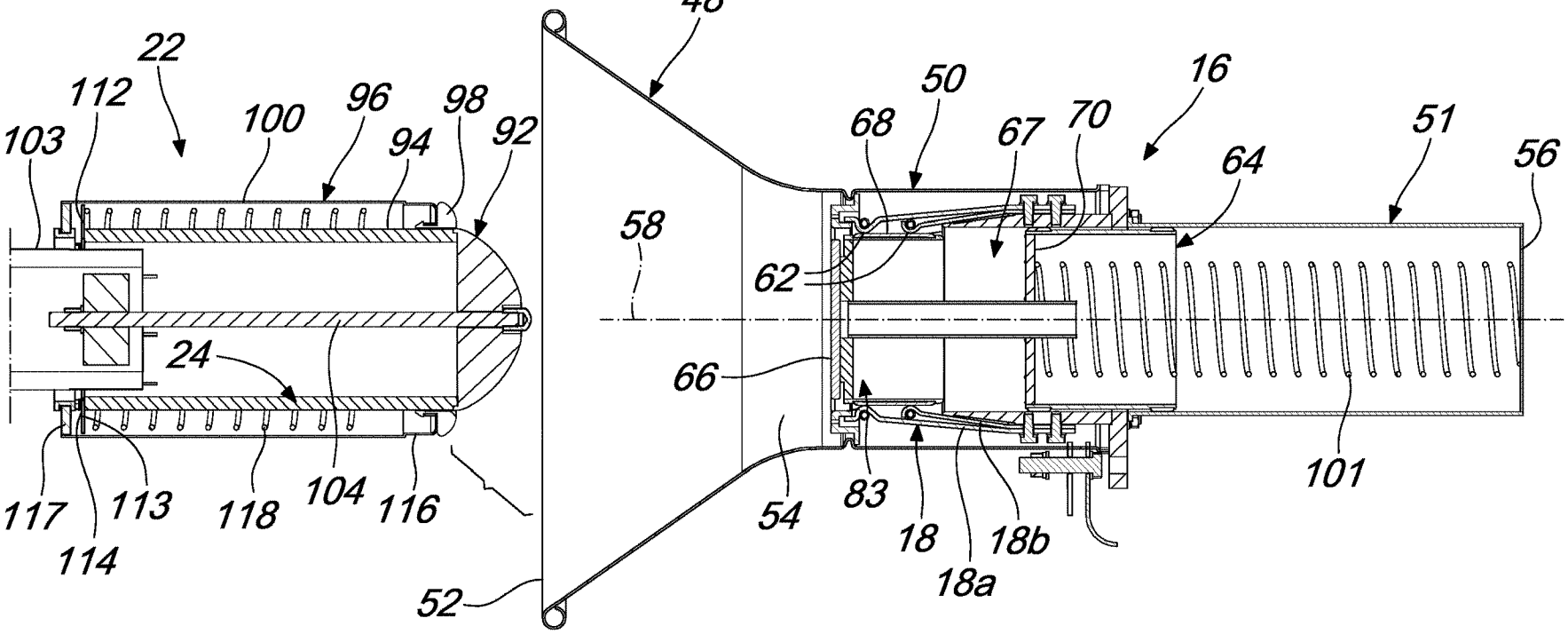
FIG. 10 is a sectional view of a portion of the movable contact and a portion of the fixed contact of the HVDC disconnector of FIG. 1 prior to engagement.

The arcing contact element 64 is movable between a first position and a second position. In FIG. 10 the arcing contact element 64 is at the first position where the arcing contact element 64 covers the contact surfaces 62 of the first and second conducting members 18. The arcing contact element 64 is in a position in the second guide portion 50 such that the first sliding surface 68 of the first sliding support 83 engages and covers the contact surfaces 62. The arcing contact element 64 is positioned to be in alignment with the contact surfaces 62 of the conducting members 18. The arcing contact element 64 is surrounded by the contact surfaces 62. The contact surfaces 62 are protected from environmental factors such as ice and pollution by the arcing contact element 64.

Figure 11:
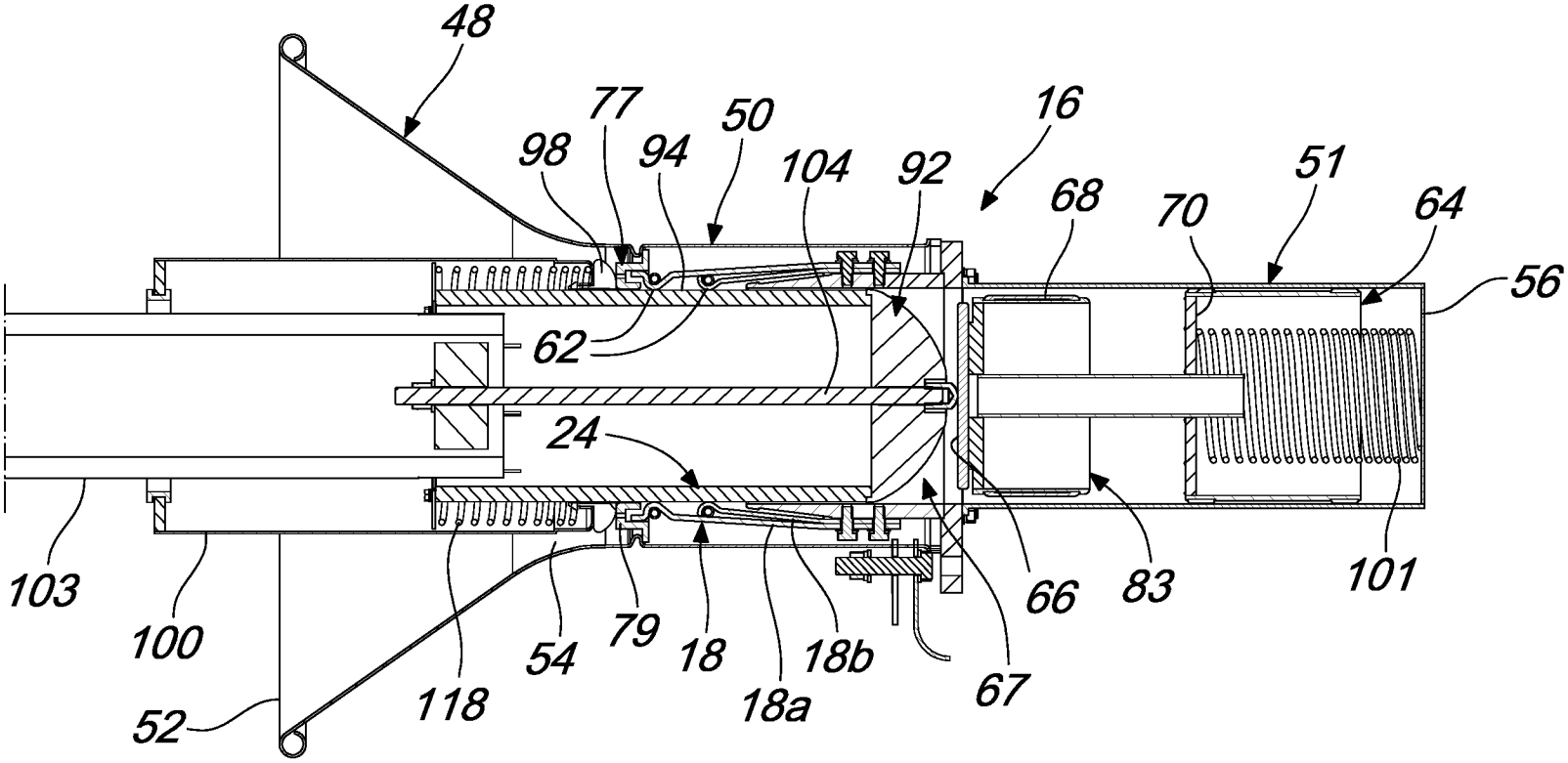
FIG. 11 is a sectional view of a portion of the movable contact and a portion of the fixed contact of the knee-type HVDC disconnector of FIG. 1 at engagement.

With reference to FIG. 11, at the second position, the arcing contact element 64 does not cover the contact surfaces 62 of the conducting members 18. At the second position, the contact surfaces 62 are exposed for contact with a conducting element 24 of the movable contact 14. The arcing contact element 64 is in a position in the third guide portion 51 so as to leave the contact surfaces 62 exposed. The first sliding surface 68 is spaced away from the contact surfaces 62.

The arcing contact element 64 is biasingly supported in the guide 16. The arcing contact element 64 is biased towards the first position by the biasing element 101. The biasing element 101 applies a biasing force on the arcing contact element 64 in a direction away from the closed end 56 and towards the first opening 52. In an embodiment, the biasing force applied by the biasing element 101 is parallel to the longitudinal axis 58. The biasing force applied by the biasing element 101 is aligned to the longitudinal axis 58. Without another force acting on the arcing contact element 64, the biasing element 101 maintains the arcing contact element 64 at the first position. When an opposing force is applied to a level exceeding the biasing force, the arcing contact element 64 is moved from the first to the second position.

The biasing element 101 is positioned between the arcing contact element 64 and the closed end 56. The biasing element 101 is positioned between the biasing surface 70 and the closed end 56. As the first arcing contact element 64 is movable relative to the closed end 56 the biasing force tends to move the slider 96 to the first position. An end of the biasing element 101 is positioned within the second skirt 95. In an embodiment, the biasing element 101 is a spring.

With reference to FIG. 1, the movable contact 14 is positioned on a flange 72. Flange 72 is configured to serve as support structure for the movable contact 14. Flange 72 has a form of a flat panel with a planar surface 74. Flange 72 has a resting plane which defined by the planar surface 74 thereof. Flange 72 has sides 76 that are connected to the planar surfaces 74. Flange 72 may be formed from aluminium.

Figure 6:
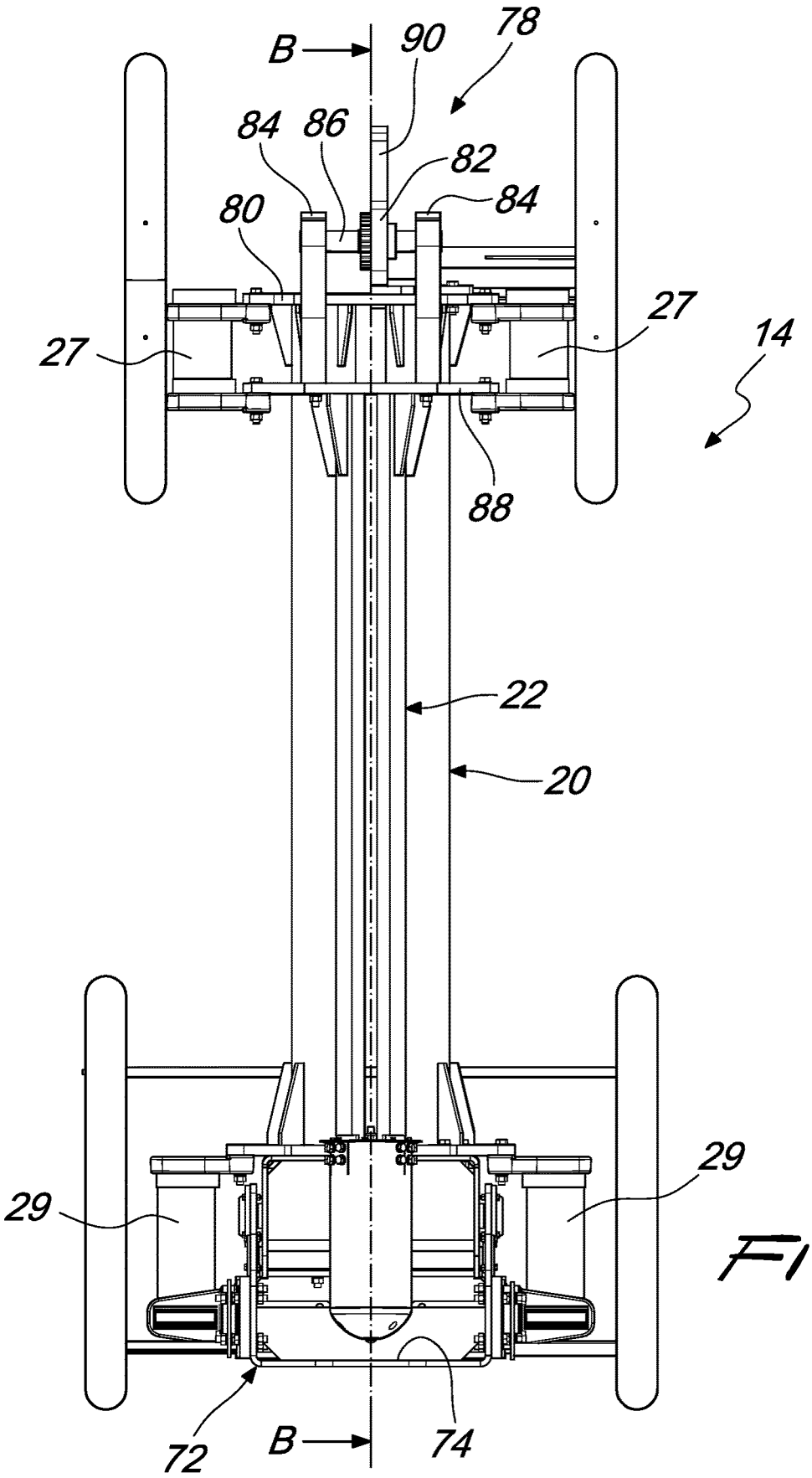
FIG. 6 is a front view of the movable contact of the knee-type HVDC of FIG. 1.
Figure 7:
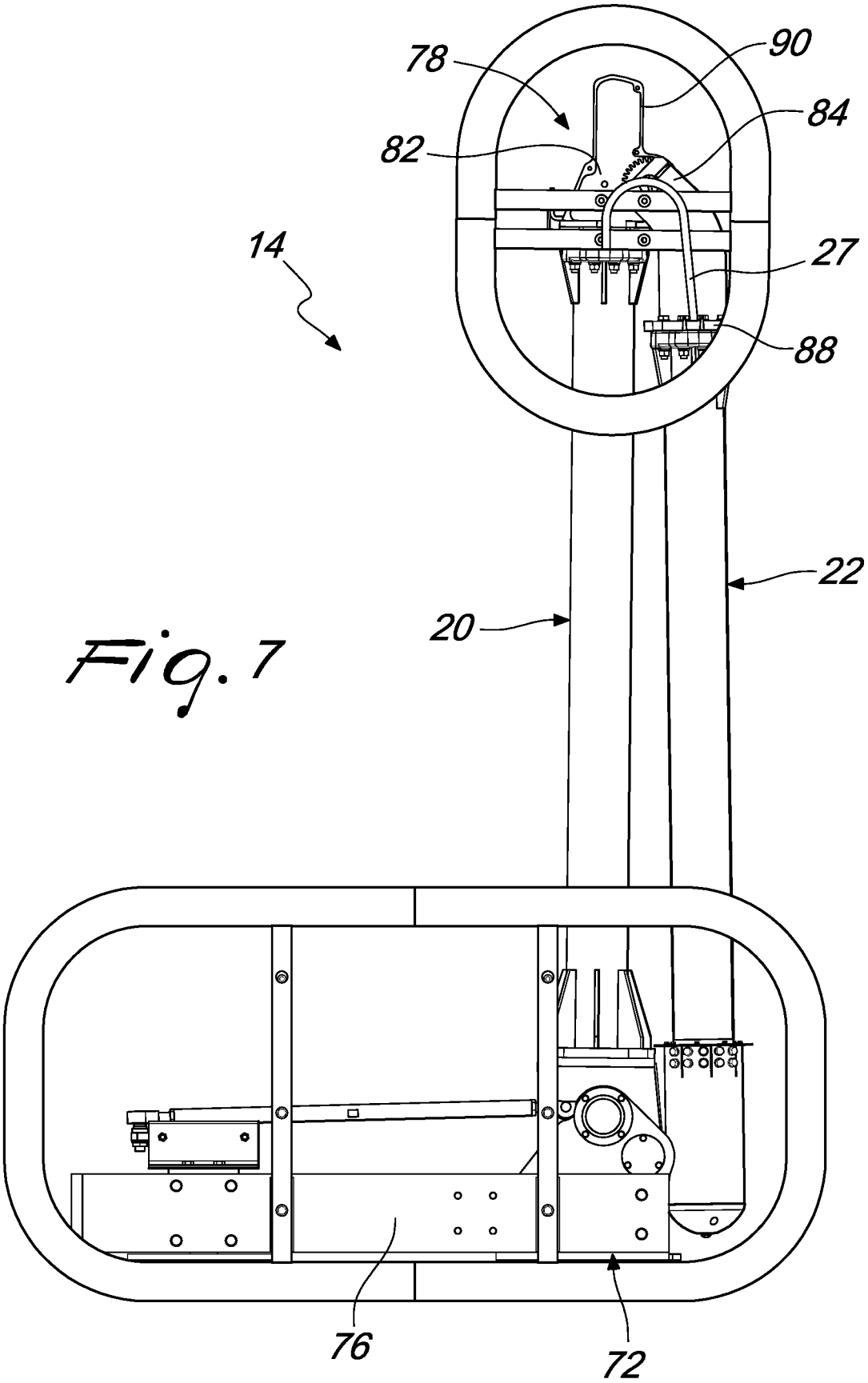
FIG. 7 is a side view of the movable contact of FIG. 6.

With reference to FIGS. 6 and 7, the movable contact 14 comprises a first mobile arm 20 and a second mobile arm 22. The first mobile arm 20 maintains the movable contact 14 in connection to a support structure through flange 72. First mobile arm 20 is connected to the flange 72. First mobile arm 20 is movably connected to the flange 72. First mobile arm 20 is rotatably connected to the flange 72. First mobile arm 20 is movable along a plane that is perpendicular to the planar surface 74. First mobile arm 20 is extends in a direction away from the flange 72. First mobile arm 20 is substantially perpendicular to the planar surface 74.

Movable contact 14 is provided with flexible aluminium connections 27,29. A pair of flexible aluminium connections 27 are provided between the first mobile arm 20 and the second mobile arm 22. A pair of flexible aluminium connections 29 are provided between the first mobile arm 20 and the flange 72. Flexible aluminium connections 27,29 enable the transmission of electrical current between the first mobile arm 20, the second mobile arm 22 and the flange 72 that have mutual relative movement.

First mobile arm 20 is composed of a pair of tubes. The tubes are hollow. The tubes are positioned to be mutually adjacent. Ends of each tube is connected to the planar surface 74 of the flange 72. The tubes enable heat to be dissipated effectively from the movable contact 14.

Movable contact 14 further comprises a pivot connection 78 for connection between the first mobile arm 20 and the second mobile arm 22. Pivot connection 78 comprises a base plate 80, a hinge connection 82 and a pair of pin connections 84. The base plate 80 is positioned on the end of the first mobile arm 20 that is opposite the end connected to the flange 72. Base plate 80 is substantially parallel to the planer surface 74.

Hinge connection 82 is positioned on the base plate 80. Hinge connection 82 is positioned on the side of the base plate 80 opposite to the side connected to the first mobile arm 20. Hinge connection 82 has a limit extension 90 extending in a direction away from the base plate 80. Limit extension 90 limits the movement of the second mobile arm 22.

Pin connections 84 are rotatably engaged with the hinge connection 82. Pin connections 84 are positioned on opposite sides of the hinge connection 82. Pin connections 84 are rotatably engaged to the hinge connection through a pin 86. The pin 86 engages in a hole extending transversely through the hinge connection 82. Pin 86 extends in a direction substantially perpendicular to the first mobile arm 20. Pin 86 extends in a direction substantially perpendicular to the second mobile arm 22.

The second mobile arm 22 is movable along a plane that is parallel to the first mobile arm 20 through the pivot connection 78. The second mobile arm 22 is movable along a plane that is parallel to the longitudinal axis of the first mobile arm 20 through the pivot connection 78. Movement of the of the second mobile arm 22 along the plane is limited by the limit extension 90. In an embodiment, second mobile arm 22 has a form of a rod.

Second mobile arm 22 is rigidly connected to the pair of pin connections 84 at an end. Second mobile arm 22 is connected to the pair of pin connections 84 through a support plate 88. Support plate 88 abuts the limit extension 90 to limit movement of the second mobile arm 22.

The second mobile arm 22 is movable from an open position to a closed position to close a connection between the fixed contact 12 and the second contact 14. With reference to FIG. 10, at the open position the second mobile arm 22 is spaced away from the guide 16. The second mobile arm 22 is not positioned in the guide 16. With reference to FIG. 11, the second mobile arm 22 is at the closed position. Second mobile arm 22 is inserted into the guide 16. Second mobile arm 22 may be in electrical connection with the pair of conducting members 18. Second mobile arm 22 is actuatable to move between the open and closed positions by an operator.

Figure 8:
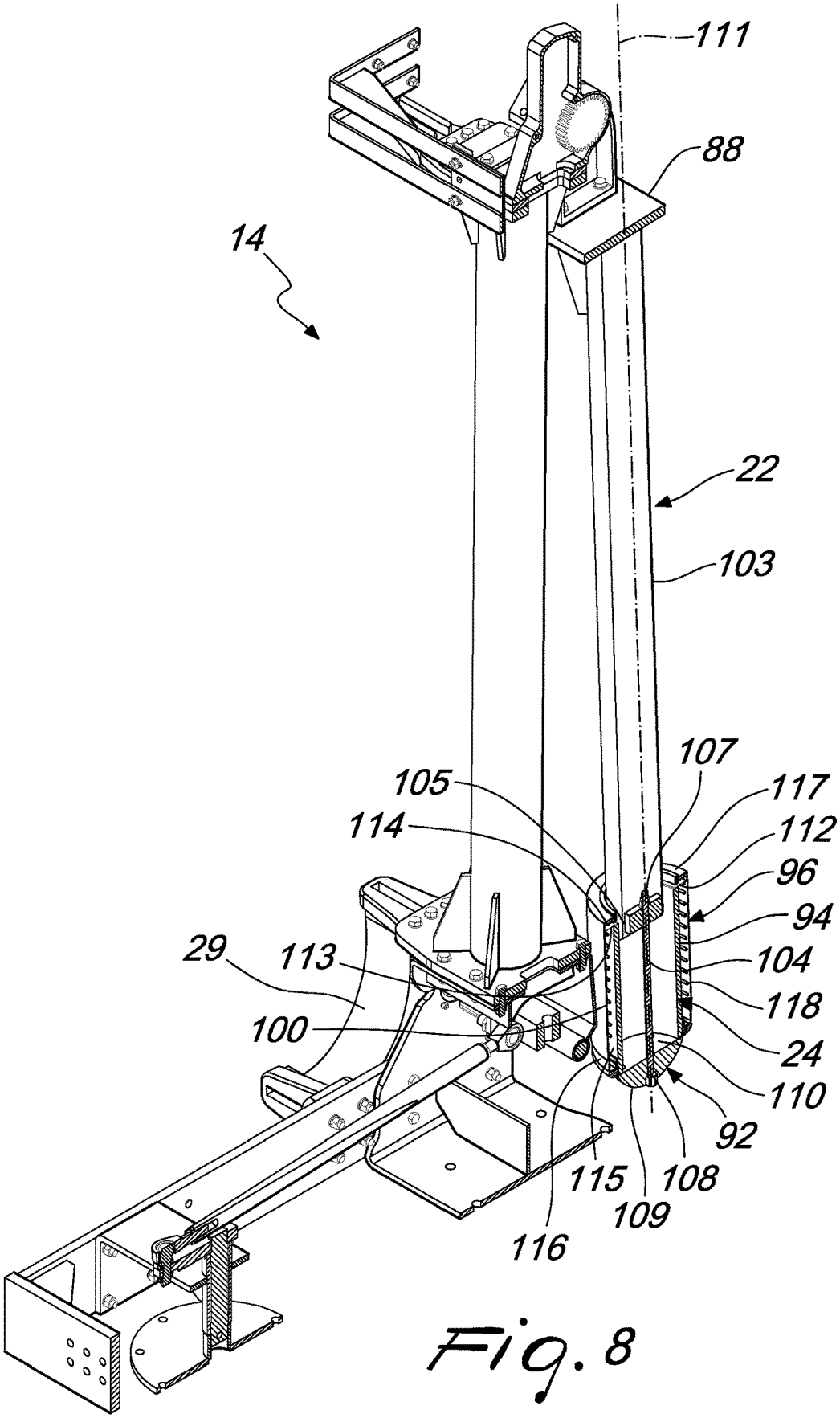
FIG. 8 is a sectional view of the fixed contact.
Figure 9:
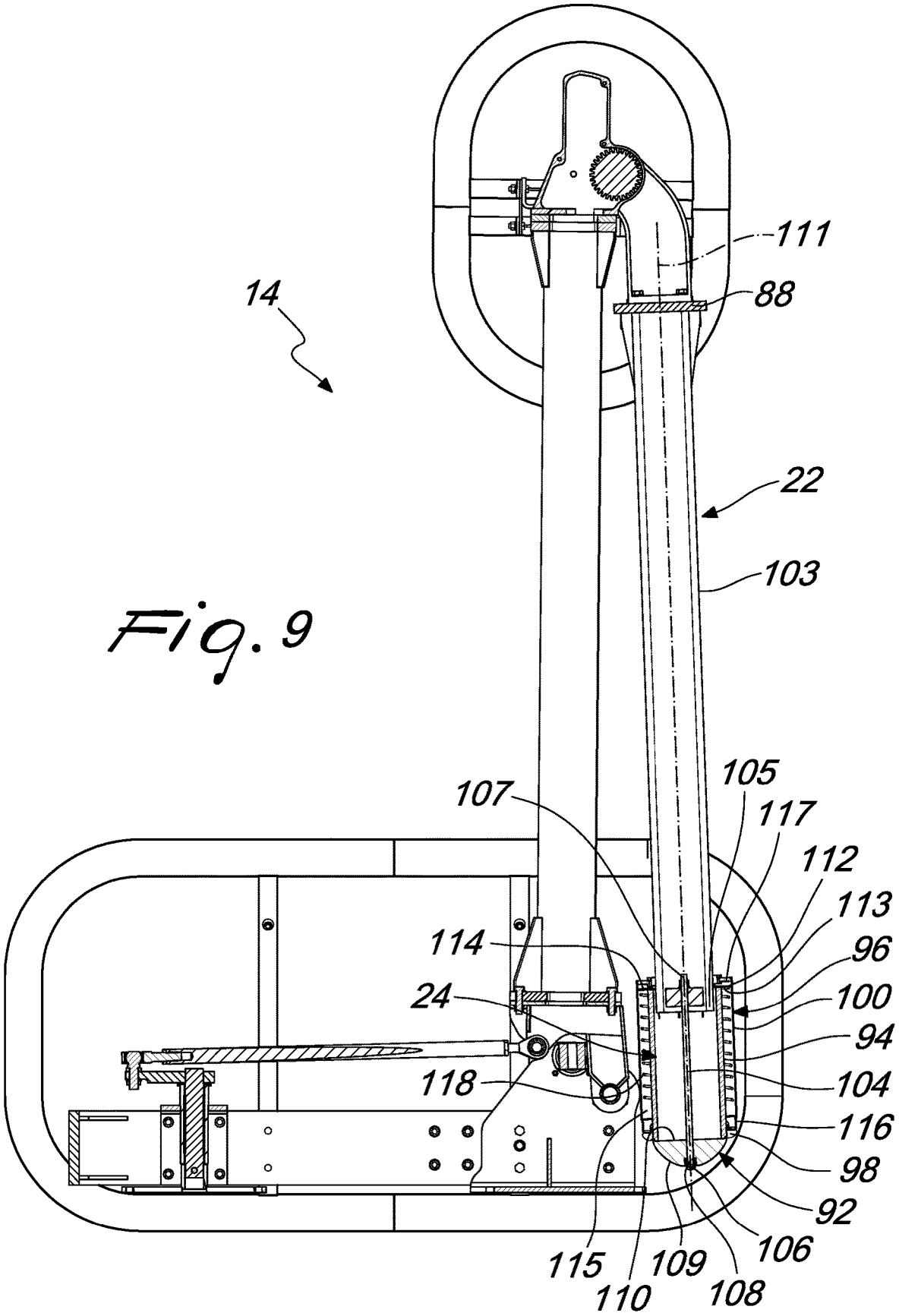
FIG. 9 is a cross-sectional view through the line B-B of the fixed contact of the FIG. 6.

With reference to FIGS. 8 and 9, the second mobile arm 22 has a conducting element 24 for electrical connection with the first and second conducting members 18 of the fixed contact 12. The second mobile arm 22 comprises a rod 103. The rod 103 is connected at an end to the support plate 88. The conducting element 24 is coupled to the rod 103. Rod 103 has a longitudinal axis 111. The longitudinal axis 111 represents the longitudinal axis of the second mobile arm 22. Conducting element 24 has a contact surface 94 for engagement with the contact surfaces 62 of the first and second conducting members 18. The contact surface 94 may encircle the conducting element 24. In an embodiment, the conducting element 24 is formed from silvered copper.

The conducting element 24 is formed as a hollow tube. The conducting element 24 has a diameter that is greater than the diameter of the rod 103. A free end 105 of the rod 103 partially extends into the conducting element 24 such that an end of the conducting element 24 overlaps the free end 105. Free end 105 is in contact with the internal wall of the conducting element 24.

Second mobile arm 22 has an abutting tip 92 for abutting engagement with the arcing contact element 64. The abutting tip 92 is connected to the rod 103. The abutting tip 92 is spaced from the free end 105 of the rod 103. The abutting tip 92 is held in a position that is spaced from the free end of the rod 103. Abutting tip 92 may have an arcuate surface 109 and a planar surface 110. The planar surface 110 faces the free end 105 of the rod 103. The abutting tip 92 has a diameter that is greater than the diameter of the rod 103. The abutting tip 92 has a diameter that is substantially equal to the diameter of the conducting element 24.

In an embodiment, a bar 104 rigidly connects abutting tip 92 to the rod 103. The bar 104 is mechanically connected at opposite ends respectively to the abutting tip 92 and the rod 103. Bar 104 is inserted into the abutting tip 92 and the rod 103 at respective ends. Bar 104 in inserted into a central point in the abutting tip 92.

The bar 104 extends through the abutting tip 92. The first terminal end 108 of the bar 104 is capped by a stud 106 at arcuate surface 109. Stud 106 partially extends into the abutting tip 92 so as to surround the terminal end 108. A portion of the stud 106 is exposed from the abutting tip 92. The stud 106 is located at the apex of the abutting tip 92. At the second terminal end 107, the bar 104 is connected to the free end 105. Bar 104 is aligned to the longitudinal axis 111 of the rod 103. The central axis of the abutting tip 92 is aligned to the longitudinal axis 111 of the rod 103.

In an embodiment, the abutting tip 92 rigidly couples the conducting element 24 to the rod 103. An end of the conducting element 24 is connected to the abutting tip 92. The conducting element 24 is connected to the planar surface 110 of the abutting tip 24. Contact surface 94 is aligned to the edges of the planar surface 110 and the arcuate surface 109. Arcuate surface 109 is contiguous with the contact surface 94. Conducting element 24 overlaps the free end of rod 103 at the end opposite the end connected to the abutting tip 92. Conducting element 24 is coaxial with the rod 103. The central axis of the conducting element 24 is aligned to the longitudinal axis 111 of the rod 103.

A limit element 112 is mounted to the end of the conducting element 24 that overlaps the free end 105 of the rod 103. The limit element 112 is mounted to the end of the conducting element 24 that is opposite to the end connected to the abutting tip 92. Limit element 112 is mounted at the edge of the limit element 112. Limit element 112 encircles the end of the conducting element 24.

Limit element 112 has a form of a flat ring. The limit element 112 has a central hole through which the free end 105 of rod 103 extends. The limit element 112 extends away from the rod 103 in a direction substantially perpendicular to the longitudinal axis 111 of the rod 103. The limit element 112 presents a first limit surface 113 and a second limit surface 114 that each forms a ring platform around the contact surface 94. First and second limit surfaces 113, 114 are formed on opposite sides of the limit element 112. First and second limit surfaces 113, 114 are substantially perpendicular to the longitudinal axis 111 of the rod 103.

The movable contact 14 further comprises a slider 96. Slider 96 is movably supported on the second mobile arm 22. Slider 96 is movable along the second mobile arm 22. Slider 96 is movable along a direction that is substantially parallel to the longitudinal axis 111. The slider 92 has a substantially cylindrical form. Slider 96 is a hollow cylinder. Slider 96 has a central through hole 115.

Slider 96 has an annular body 100 bound at respective ends by a first limit body 116 and a second limit body 117. First limit body 116 and second limit body 117 partially occlude the through hole 115 at the respective ends. Annular body 100 is spaced from the mobile arm 22 by the first limit body 116 and the second limit body 117. Annular body 100 may be positioned over the rod 103 or the conducting element 24 depending on the position of the slider 96.

First limit body 116 and second limit body 117 are formed as rings with apertures. First limit body 116 and second limit body 117 are formed as separate bodies joined to the annular body 100. In an embodiment, first limit body 116 and second limit body 117 are formed from the annular body 100.

First limit body 116 is configured to slide on the conducting element 24. First limit body 116 is configured to slide on the contact surface 94. Second limit body 117 is configured to slide on the rod 103. Limit element 112 is disposed between the first limit body 116 and second limit body 117. The limit element 112 is positioned in the through hole 115 with the slider 96 coupled to the rod 103. Limit element 112 limits the movement of the slider 96 on the second mobile arm 22. Limit element 112 limits the sliding movement of the slider 96 along the second mobile arm 22. First limit body 116 is limited by the first limit surface 113 and second limit body 117 is limited by the second limit surface 114.

The aperture of the first limit body 116 has a diameter that is greater relative to the diameter of the aperture of the second limit body 117. The diameter of the aperture of the first limit body 116 is greater relative to the respective diameters of the rod 103 and the conducting element 24. The diameter of the aperture of the second limit body 117 is greater relative to the diameter of the rod 103 and smaller relative to the diameter of the conducting element 24. First limit body 116 and/or second limit body 117 may further comprise a gasket for sliding contact on the conducting element 24 and on the rod 103 respectively. The gasket may be positioned between the first limit body 116 and/or second limit body 117 and the conducting element 24 and the rod 103 respectively.

The slider 96 is movable between a first position and a second position. In FIG. 10, the slider 96 is at the first position where the slider 96 is disposed over the contact surface 94 of the conducting element 24. The slider 96 is in a position on the second mobile arm 22 such that the annular body 100 covers the contact surface 94. The annular body 100 is positioned to be in alignment with the contact surface 94. The annular body 100 surrounds the contact surface 94. The contact surface 94 is protected from environmental factors such as ice and pollution by the slider 96.

With reference to FIG. 11, at the second position, the slider 96 does not cover the contact surface 94 of the conducting element 24. At the second position of the slider 96 the contact surface 94 is exposed for contact with the pair of conducting members 18 of the fixed contact 12. The slider 96 is in a position on the second mobile arm 22 so as to leave the contact surface 94 exposed.

With reference to FIGS. 8 and 9, slider 96 is biasingly supported on the second mobile arm 22. The slider 96 is biased towards the first position by a biasing element 118. The biasing element 118 applies a biasing force on the slider 96 in a direction away from free end 105 towards the abutting tip 92. In an embodiment, the biasing force is parallel to the longitudinal axis 111. Without another force acting on the slider 96, the biasing element 118 maintains the slider 96 at the first position. When an opposing force is applied at a level greater than the biasing force, the slider 96 is moved from the first to the second position.

The biasing element 118 is positioned between the limit element 112 and the first limit body 116. The biasing element 101 is positioned between the first limit surface 113 and the first limit body 116. As the first limit body 116 is movable relative to the limit element 112 the biasing force tends to move the slider 96 to the first position. Biasing element 118 is positioned within the through hole 115. Biasing element 118 is positioned between the annular body 100 and the contact surface 94. In an embodiment, the biasing element 118 is a spring.

In an embodiment, slider 96 is actuable between the first and second positions. The slider 96 is configured to be retractable from the first position to the second position. A retracting mechanism (not shown) is provided to move the slider 96 between the first and second positions. The force applied by the retracting mechanism applies a force on the slider 96 in a direction is parallel to the longitudinal axis 111.

In an embodiment, slider 96 has an engagement element 98. Engagement element 98 is positioned adjacent to the first limit body 116. Engagement element 98 is positioned on the side of the first limit body 116 opposite the side in contact with the biasing element 118. Engagement element 98 may be formed as a separate body and joined to the first limit body 116. Engagement element 98 may have a form of a ring. In a further embodiment, engagement element 98 may be formed as a part of the first limit body 116.

With reference to FIGS. 10 and 11, engagement element 98 is available for abutting contact with the engagement portion 79 of the abutting element 77. Engagement element 98 faces the same direction as the abutting tip 92.

With reference to FIG. 10, the second mobile arm 22 is at an open position. The second mobile arm 22 is positioned away from the guide 16. The slider 96 is at the first position so as to cover the contact surface 94 of the conducting element 24. The arcing contact element 64 is at the first position so as to cover the contact surfaces 62 of the conducting members 18.

With reference to FIG. 11, the second mobile arm 22 is at a closed position. The second mobile arm 22 is inserted into the guide 16. The conducting element 24 is inserted into the second guide portion 50. The slider 96 is at the second position so as to expose the contact surface 94 of the conducting element 24. The arcing contact element 64 is at the second position so as to expose the contact surfaces 62 of the conducting members 18. The contact surface 94 of the conducting element 24 is in engagement with the contact surfaces 62 of the pair of conducting members 18. The position of the slider 96 at the second position on the second mobile arm 22 provides a visual indication of insertion of the conducting element 24 into the second guide portion 50.

The second mobile arm 22 is moved towards the guide 16 by movement of first mobile arm 20 moving relative to the flange 72. The first mobile arm 20 may be pivoted towards the guide 16.

A method of closing a connection in a HVDC disconnector 10 will now be described. The method comprises the step of actuating a movable contact 14 having a first mobile arm 20 and a second mobile arm 22 having a conducting element 24 so as to move the second mobile arm 22 from an open position to a closed position in a fixed contact 12 comprising a guide 16 and a first and second conducting members 18 disposed in the guide 16. In an embodiment, an operator may actuate the movable contact 14 so as to move the second mobile arm 22 to the second position in the second guide portion 50.

The method further comprises a step of moving a slider 96 movably supported on the second mobile arm 22. The method comprises a step of moving the slider 96 from a first position wherein a contact surface 94 of the conducting element 24 is covered to a closed position wherein the contact surface 94 is exposed for contact with the conducting members 18.

The slider 96 is moved from the first position to the second position by the abutment of the engagement portion 79 of the abutting element 77 with the engagement surface 98 of the slider 96. The abutment of the engagement portion 79 with the engagement surface 98 pushes the slider 96 from the first position to the second position as the second mobile arm 22 moves to the closed position. Contact surface 94 is exposed as the slider 96 moves from the first position to the second position.

The method further comprises the step of abutting an arcing contact element 64 movably supported in the guide 16 to move the arcing contact element 64 from a first position wherein contact surfaces 62 of the pair of conducting members 18 are covered to a closed position wherein the contact surfaces 62 are exposed for contact with the conducting element 24.

The arcing contact element 64 is moved from the first position to the second position by the abutment of the abutment surface 66 of the arcing contact element 64 with the abutment tip 92 of the conducting element 24. The abutment of the abutment tip 92 with the abutment surface 66 pushes the arcing contact element 64 from the first position to the second position as the mobile arm 22 moves to the closed position. Contact surfaces 62 are exposed as the arcing contact element 64 moves from the first position to the second position.

The foregoing steps are reversed in order to disconnect the electrical connection between the fixed and movable contacts 14, 12. The disconnection process is initiated by actuating the second mobile arm 22 to move from the closed position to the open position.

The skilled person would appreciate that foregoing embodiments may be modified or combined to obtain the HVDC disconnector 10 of the present disclosure.

This disclosure describes a HVDC disconnector 10, in particular for a disconnector having a rated current equivalent to 6000 Ampere and above. In an embodiment, the HVDC disconnector 10 has a rated current above 6000 Ampere.

The HVDC disconnector 10 has a high heat dissipation. The first and second conducting members 18 in the HVDC disconnector 10 enables efficient heat dissipation. Heat dissipation can occur through the guide 16.

The fixed contact of the HVDC disconnector 10 has a relatively lower weight that facilitates the efficient balancing of the fixed contact 12 so as to enable a proper insertion of the movable contact 14 into the fixed contact 12. The HVDC disconnector 10 has a relatively lower as a result of the limited number of components in the movable contact 14 and the fixed contact 12.

The insertion of the movable contact 14 into the fixed contact 12 is conspicuous to an operator by way of the slider 96 moving on the second mobile arm 22. The movement of the slider 96 provides an visible identification of the insertion of the second moveable arm 22 into the guide 16. Movement of the slider 96 occurs during the insertion of the second mobile arm 22 into the guide 16 thereby permitting an immediate evidence of a proper closing between the movable and fixed contacts 14, 12.

The contacts (conducting members 18 and conducting element 24) in the HVDC disconnector 10 are protected against elements such as pollution and ice. As the contacts 18 are protected, the duration of useful life thereof is increased.

The guide 16 of the fixed contact 12 being isolated prevents arcing to occur between the fixed and mobile contacts 12, 14. In particular, arcing is prevented during closing of the fixed and mobile contacts.

The HVDC disconnector 10 is a knee-type HVDC disconnector.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein.

Where technical features mentioned in any claim are followed by reference signs, the reference signs have been included for the sole purpose of increasing the intelligibility of the claims and accordingly, neither the reference signs nor their absence have any limiting effect on the technical features as described above or on the scope of any claim elements.

One skilled in the art will realise the disclosure may be embodied in other specific forms without departing from the disclosure or essential characteristics thereof. The foregoing embodiments are therefore to be considered in all respects illustrative rather than limiting of the disclosure described herein. Scope of the invention is thus indicated by the appended claims, rather than the foregoing description, and all changes that come within the meaning and range of equivalence of the claims are therefore intended to be embraced therein.

What we claim is:

1. A High-Voltage Direct Current (HVDC) disconnector comprising:

a fixed contact comprising a guide and at least a first and second conducting member positioned in the guide wherein the first and second conducting members are both tulip contacts;

a movable contact comprising a first mobile arm and a second mobile arm having a conducting element, wherein the second mobile arm is movable from an open position to a closed position to close a connection between the fixed contact and the second contact; and a slider movably supported on the second mobile arm, the slider being movable between a first position wherein a contact surface of the conducting element is covered and a second position wherein the contact surface is exposed for contact with the first and second conducting members.

2. The HVDC disconnector of claim 1 further comprising an abutting element positioned in the guide for abutting the slider so as to move the slider from the first position to the second position.

3. The HVDC disconnector of claim 1 wherein the slider is biased towards the first position by a biasing element.

4. The HVDC disconnector of claim 1 further comprising an arcing contact element movably supported in the guide, the arcing contact element being movable between a first position wherein contact surfaces of the first and second conducting members are covered and a second position wherein the contact surfaces are exposed for contact with the conducting element.

5. The HVDC disconnector of claim 4 further comprising an abutting tip provided on the second mobile arm for abutting the arcing contact element so as to move the arcing contact element from the first position to the second positioned.

6. The HVDC disconnector of claim 4 wherein the arcing contact element is biased towards the first position by a biasing element.

7. The HVDC disconnector of claim 1 wherein the guide has a first guide portion having a conical shape and a second guide portion having a tubular shape wherein the first and second conducting members are positioned in the second guide portion.

8. The HVDC disconnector of claim 7 wherein the guide further comprises a collar positioned in a lumen of the second guide portion for cantilever anchorage of the first and second conducting members.

9. The HVDC disconnector of claim 7 wherein the first and second conducting members are positioned in series relative to a longitudinal axis of the second guide portion.

10. The HVDC disconnector of claim 1 wherein each tulip contact comprises a plurality of fingers each having a contact surface.

11. The HVDC disconnector of claim 1 wherein the HVDC disconnector is a knee type disconnector.

12. A method of closing a connection in a HVDC disconnector, the method comprising:

actuating a movable contact having a first mobile arm and a second mobile arm having a conducting element so as to move the second mobile arm from an open position to a closed position in a fixed contact comprising a guide and at least a first and second conducting member disposed in the guide wherein the first and second conducting members are both tulip contacts; and moving a slider movably supported on the second mobile arm from a first position wherein a contact surface of the conducting element is covered to a second position wherein the contact surface is exposed for contact with the first and second conducting members.

13. The method of claim 12 further comprising:

moving an arcing contact element movably supported in the guide from a first position wherein contact surfaces of the first and second conducting members are covered to a second position wherein the contact surfaces are exposed for contact with the conducting element.

* * * * *